US005582535A

United States Patent [19]

Friel

[11] Patent Number: 5,582,535

[45] Date of Patent: Dec. 10, 1996

[54] METHOD AND APPARATUS FOR KNIFE AND BLADE SHARPENING

[75] Inventor: Daniel D. Friel, Greenville, Del.

[73] Assignee: Edgecraft Corporation, Avondale, Pa.

[21] Appl. No.: 466,451

[22] Filed: Jun. 6, 1995

Related U.S. Application Data

[63] Continuation-in-part of Ser. No. 391,250, Feb. 21, 1995, abandoned, which is a continuation of Ser. No. 55,856, Apr. 30, 1993, Pat. No. 5,390,431, which is a continuation-in-part of Ser. No. 901,213, Jun. 18, 1992, Pat. No. 5,404,679.

[51] Int. Cl.[6] ..... B24B 1/00

[52] U.S. Cl. ..... 451/45; 451/58; 451/321; 451/349; 451/555; 451/558

[58] Field of Search ..... 451/45, 57, 58, 451/162, 319, 321, 349, 406, 540, 555, 556, 557, 558

[56] References Cited

U.S. PATENT DOCUMENTS

| | | | |
|---|---|---|---|
| 1,570,083 | 1/1926 | Runzi | 451/552 |
| 2,092,443 | 9/1937 | Crossley | 451/558 |
| 2,767,530 | 10/1956 | Pladanius | 451/585 |
| 3,956,856 | 5/1976 | Yonkers | 451/164 |
| 4,280,378 | 7/1981 | Levine | 437/2 |
| 4,528,777 | 7/1985 | Bernstein et al. | 451/45 |
| 4,716,689 | 1/1988 | Miquelot | 451/552 |
| 4,934,110 | 6/1990 | Juranitch | 451/555 |

*Primary Examiner*—Timothy V. Eley
*Attorney, Agent, or Firm*—Connolly & Hutz

[57] ABSTRACT

An apparatus for sharpening the edge of an elongated object includes a housing having an exposed sharpening section with a sharpening element in the sharpening section. The sharpening element is formed from a single abrasive coated sharpening element having a pair of abrasive coated planar comb-like structures formed along opposing sides of the sharpening element. The sharpening element is bent into an X configuration wherein the alternating teeth and slots interdigitate to form the X-shaped configuration and form a sharpening angle between the interdigitating teeth. The sharpening angle has a bisection line with an elongated interrupted sharpening surface. Each of the teeth from one of the comb-like structures is juxtaposed at least one tooth from the other of the structures to form that interrupted sharpening surface with the plurality of abrasive surfaces and a plurality of open areas whereby the edge being sharpened is subjected to repeated alternating contact with the surface of each comb-like structure as the object is moved through the sharpening section.

18 Claims, 2 Drawing Sheets

METHOD AND APPARATUS FOR KNIFE AND BLADE SHARPENING

CROSS-REFERENCE TO RELATED APPLICATION

This application is a continuation-in-part of application Ser. No. 08/391,250 filed Feb. 21, 1995, now abandoned, which in turn is a continuation of application Ser. No. 08/055,856 filed Apr. 30, 1993, which is now U.S. Pat. No. 5,390,431, which in turn is a continuation-in-part of Ser. No. 07/901,213 filed Jun. 18, 1992, now U.S. Pat. No. 5,404,679.

BACKGROUND OF THE INVENTION

Patent U.S. Pat. No. 5,390,431 describes a method and apparatus for knife and blade sharpening. As described therein a pair of rigidly stationary mounted members having abrasive coated surfaces are juxtaposed each other. The surfaces cross to form a rigid structural vertex or two non-movably rigidly mounted members, each being a planar comb-like structure having an elongated base portion, each abrasive coated and each interdigitating with the other. It would be desirable if the advantages of this structure could be achieved without requiring two separate members.

SUMMARY OF THE INVENTION

An object of this invention is to provide an apparatus for sharpening the edge of an elongated object which attains the advantages of U.S. Pat. No. 5,390,431 while using structure which differs from the structure described in that patent.

In accordance with this invention the advantages of the two piece structure described in U.S. Pat. No. 5,390,431 can be created with a single piece of metal, with teeth along two sides suitably abrasive coated and suitably bent to form the interdigitating structure. This, surprisingly, results in a simpler, less expensive construction that offers some practical advantages and a readily adjustable means of varying the angle between the abrasive coated surfaces.

This new construction can be readily adapted for many abrading applications including sharpening of cutting blades or truing the edges (corners) of skis and skates.

A BRIEF DESCRIPTION OF THE DRAWINGS

DETAILED DESCRIPTION

The sharpener of this invention is based upon the concepts of the sharpener shown and described in U.S. Pat. No. 5,390,431, the details of which are incorporated herein by reference thereto. In addition, the details of abandoned parent application Ser. No. 901,213 are also incorporated herein by reference thereto. Since the present invention is based upon variations of the sharpening apparatus disclosed in U.S. Pat. No. 5,390,431, all of the details of that apparatus will not be repeated herein.

U.S. Pat. No. 5,390,431 describes a sharpening section of a knife and blade sharpener which is formed by having two separate comb like members with spaced teeth being interdigitated to form a structure which is generally X-shaped wherein the exposed portion of the X has alternating teeth and slots. The teeth are abrasive coated so that an edge being sharpened when placed in the sharpening angle between the interdigitating teeth is subjected to repeated alternating contact with the surface of the teeth of each of the comb like structures. The present invention in one aspect involves the use of a single member which can form the X-shape described in U.S. Pat. No. 5,390,431 and thereby have its advantages.

Figure 1:
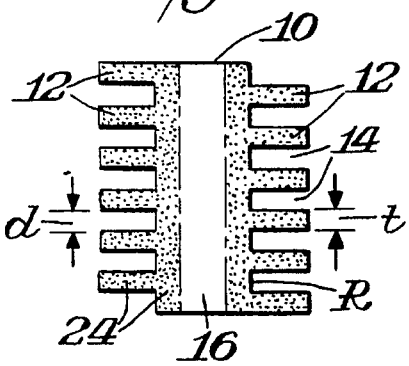
FIG. 1 is a top plan view of a stamped metal sharpening plate in accordance with this invention.
Figure 2:
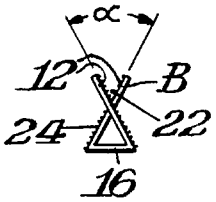
FIG. 2 is an end elevational view of the sharpening plate shown in FIG. 1 bent in its sharpening condition.

FIG. 1 illustrates a sharpening plate 10 in accordance with this invention. Sharpening plate 10 is formed with any suitable material and preferably is made from a metal which is stamped to the shape shown therein. As shown therein, the plate 10 has a series of teeth 12 and slots 14. In order to abrasively coat the teeth 12 the entire plate 10 can be abrasive coated fully on one side, or as shown in FIG. 1, plate 10 can be selectively coated only in areas 24 where the abrasive will be active in its final configuration which includes teeth 12 and a margin of area inwardly of the teeth. The back side need not be abrasive coated. The teeth 12 will in each case be narrower than the slots 14 into which they will mate when the plate 10 is bent into an interdigitating form with a base 16 as shown in FIG. 2 to result in a rigidly stationarily mounted set of sharpening members. Dimension t of FIG. 1 will be less than dimension d.

The angle $\alpha$ (FIG. 2) formed between the interdigitating teeth 12 determines the sharpening angle—namely the total angle between the two facets of an edge formed by passing a knife 20 edge along the intersection line 22 or vertex formed by the abrasive surfaces where they cross. Intersection line 22 is slightly above the root or base lines R of the slots 14 by an amount related to the thickness of the teeth and the sharpening angle. See FIG. 5.

Figure 3:
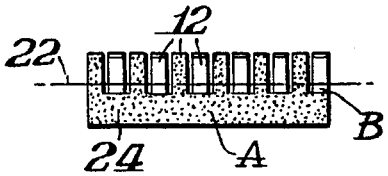
FIG. 3 is a side elevational view of the sharpening plate shown in FIG. 2.

A surprising advantage of this construction is the openness of the abrasive surfaces which allows the swarf, metal particles abraded off the knife in sharpening, to fall freely from the sharpening areas and from the vertex line. This is a major advantage where food or foreign material might otherwise tend to collect along the vertex or sharpening line and interfere with the sharpening action. This is illustrated in FIG. 3. The area below each abrasive tooth 12 is open and debris is unobstructed as it falls below the vertex line where the knife edge is formed by the abrasive action. The same would be true on the opposite side of the sharpener below the active sharpening area.

Figure 4:
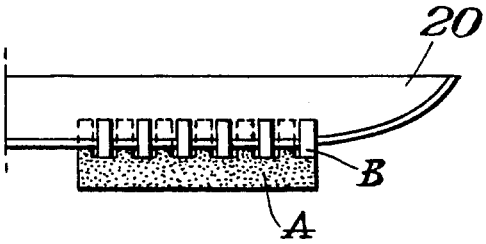
FIG. 4 is a side elevational view similar to FIG. 3 and showing a knife being sharpened.

FIG. 4 shows the configuration of FIGS. 2–3 with a knife blade 20 in place. The sections marked B are the backs of the teeth which contain no abrasive coating on that side.

The abrasive coated area 24 is shown extending below the vertex intersection line 22, as it might be in practice to insure adequate coating area without imposing severe restrictions on manufacturing tolerances. Technically, the abrasive need not extend below the vertex 22 in order to carry out the intentions of this invention.

Figure 5:
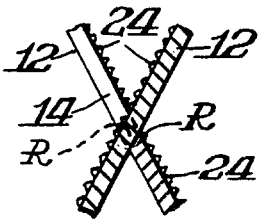
FIG. 5 is a fragmental end elevational view showing an alternative construction for the sharpening plate of FIG. 2.

The position of the interdigitating teeth and the angle of intersection can in one configuration be controlled conveniently by selecting the depth of each tooth such that when formed into the configuration of FIG. 5, the back of each tooth rests against the root R of the mating tooth section. This adds strength to the construction and minimizes the opportunity for the sharpening angle to change while the sharpener is being used.

Figure 6:
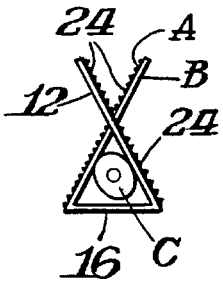
FIG. 6 is an enlarged end elevational view showing a modified form of sharpening plate in accordance with this invention.

Alternatively suitable rods or cams, C, can be inserted below the vertex and between the bent sides as shown in FIG. 6. Merely by changing the diameter of the rod or by rotating a cam, the angular separation of the sides and the abrasive surfaces can be altered. This makes it possible to change the angle at will or to make it continuously variable for sharpening at several different angles. Triangular or rectangular forms instead of rods also may be inserted into the triangular space between the sides to establish or alter the sharpening angle. It is preferred that once the angle is thus selected, it will not be later changed.

Where no adjustment of the angle is necessary a configuration similar to FIG. 6 but without the cam can be insert molded into a plastic holder that can serve as a convenient handle or support means. Several such sharpening elements can be molded into a common support or handle to provide multistage sharpening at different angles and with different abrasive grit sizes.

Figure 8:
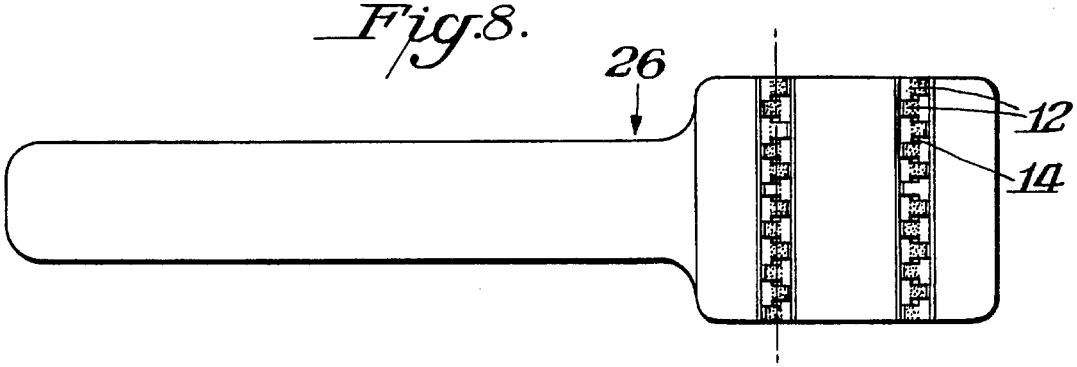
FIG. 8 is a top plan view of the sharpener shown in FIG. 7.
Figure 7:
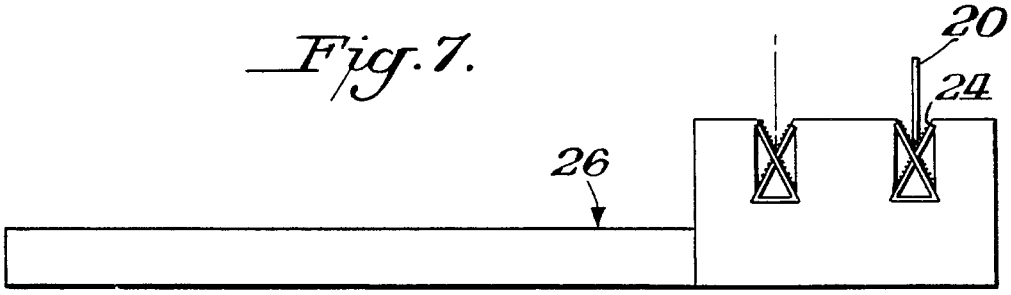
FIG. 7 is a side elevational view of a portable manual sharpener having two sharpening plates in accordance with this invention.

This new technology makes it possible to construct relatively inexpensive and readily portable sharpeners. FIGS. 7–8 show one of the possibilities of sharpeners 26.

The handle of sharpener 26 in FIGS. 7–8 can be made thin enough to fit in a knife block slot or cutting board slot during periods of non-use.

One or more sharpening elements similar to those of FIGS. 2 thru 6 can be mounted into or insert molded into the housing of sharpener 26 as illustrated in FIGS. 7–8 to create a small yet efficient two stage sharpener. In use this can be placed on a raised surface so that the knife edge can be conveniently moved back and forth through the sharpening slots. The first stage would for example be a coarse grit creating a first edge on the blade facets at a first angle and the second stage with a fine grit would create a second bevel on the facets at a slightly larger angle. The unit is small enough that it can also be used in another manner—namely by passing the sharpener back and forth along the edge of a stationary blade.

Figure 9:
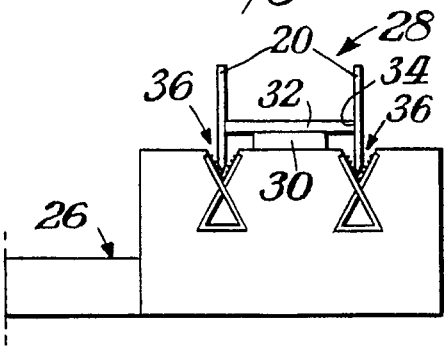
FIG. 9 is a partial side elevational view of a sharpener in accordance with this invention using stationary knife guides.

As a further modification of the sharpener illustrated in FIGS. 7 and 8, it is desirable to provide means for angle control of the blade during sharpening as discussed in the parent patent U.S. Pat. No. 5,390,431 where specially shaped roller guides are described. Rollers and ball bearings provide excellent blade guides to hold the center line of the blade approximately at the bisection of the angles of the abrasive surface. In a less expensive version a stationary guide can be added as shown in FIG. 9. Other versions are shown in FIGS. 10–13.

FIG. 9 illustrates a guide assembly 28 in the form of a base 30 mounted on the sharpener 26. A cross member 32 extends across base 30 and acts as a stationary guide wherein the vertical face 34 of each free end projects above the sharpening elements 36 such that when a blade 20 of average thickness rests against its end surface 34, the center line of the blade 20 will approximately bisect the included angle $\alpha$ formed by the crossing and interdigitating abrasive coated surfaces 24. It is most important that the stationary guide provide a consistent support thus insuring that the sharpening angle at the abrasive surfaces in a given stage are consistent on each and every stroke. The consistency of angle control is more important than the need to bisect precisely the included angle. By placing a slope on the vertical face 34 of the guides—as in the case of the roller guides—described in U.S. Pat. No. 5,390,431 the bisecting angle will be somewhat more consistent stage to stage and knife to knife.

Figure 10:
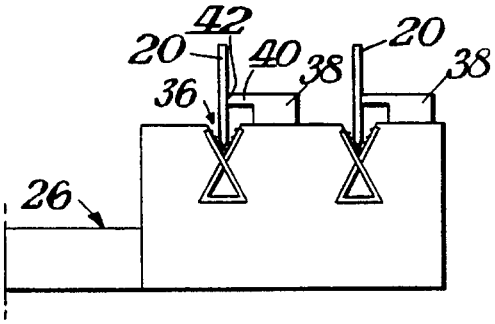
FIGS. 10–11 are partial side elevational views similar to FIG. 9 showing modified forms of knife guides.

The consistency of the angle stage to stage can be made totally consistent by using two guides, one for each stage, where individual guides operate on the same face of the blade in both stages. This is illustrated in FIG. 10. As shown in FIG. 10 each stationary guides includes a base 38 having an offset extension 40 with a face 42 for guiding the blade 20. Extension 40 may be integral with base 38.

The guide arrangements shown in FIGS. 9–10 may include one or a plurality of guides for each sharpening stage. Thus, for example, as with FIGS. 12 and 13, a single centrally located guide could be mounted on one side of each set of sharpening elements 36 or a plurality of aligned guides could be mounted on a side of each set of sharpening elements. FIG. 10 illustrates each set of guides to be mounted on the same side of the blade 20. For example, each set of guides is mounted to the right of the blade as shown in FIG. 10. If desired, however, the guides could be mounted juxtaposed each other or with each guide remote from the other guide.

Figure 11:
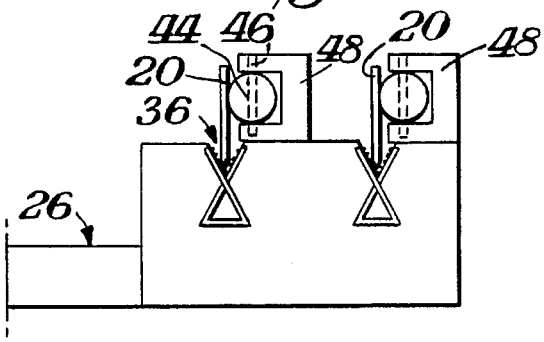

A further improvement shown in FIG. 11 uses roller balls 44 against which the knife blade 20 rests during the sharpening in each of the two stages. The balls 44 of each stage are positioned so that the position of the blade essentially bisects the sharpening angle $\alpha$ in each of the two stages. Balls 4 are mounted for rotation about shaft 46 in U-shaped block 48. The guide arrangement of FIG. 11 has the advantage that the facets created on each side of the blade are consistent stage to stage and are nearly equal angled and the knife will sharpen faster and cut evenly and along a straighter line. By using a larger sharpening angle in Stage 2 and a finer grit in that stage a second and finely finished bevel is placed on the knife after it is sharpened in Stage 1.

Figure 12:
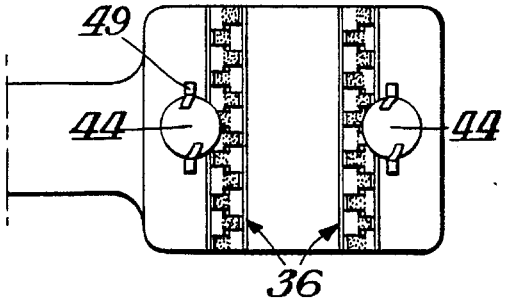
FIG. 12 is a partial top plan view of a sharpener in accordance with this invention showing roller ball knife guides.
Figure 13:
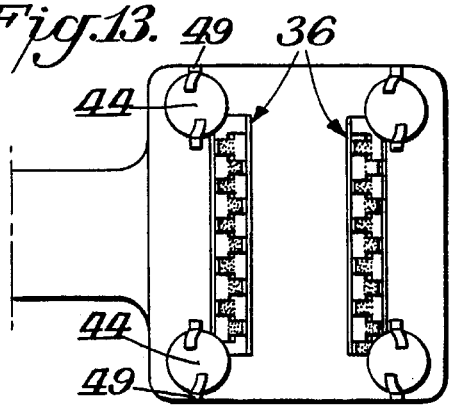
FIG. 13 is a view similar to FIG. 12 showing a modified form of roller ball guides.

In FIGS. 11, 12, and 13 are shown two of the many possible configurations for ball guides. FIG. 12 shows single ball guide 50 in each of the two sharpening stages mounted central along the length of the sharpening guides. Single balls 44 can be mounted above the vertex of the sharpening elements as represented in FIGS. 11 and 12. Alternatively a ball 44 can be located at each end of the sharpening elements are shown in FIG. 13. Although the centrally located position of FIG. 12 is easier to align, the use of two balls provides better support for the blade.

The balls would be located in any event so that when the knife is resting against the ball, the centerline of the blades will approximately bisect the angle α shown in FIG. 2.

Balls 44 could be secured in any suitable manner. As noted, FIG. 11 shows the balls to be mounted in a structural support 48. FIGS. 12–13 illustrate the use of known strip ball bearings 49 which are used to mount the balls in position while permitting rotation of the balls when contacted by the knife 20.

Figure 14:
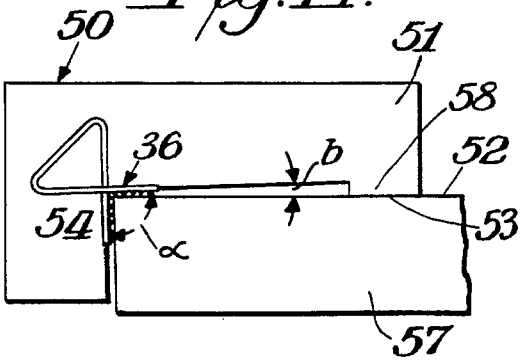
FIG. 14 is a side elevational view of a portion of the sharpener in accordance with this invention used as a ski sharpener.

This invention can be used for edging and sharpening a variety of elongated blades and knives and other objects such as skis. FIG. 14 illustrates use of the invention for skis where the formed and bent interdigitating structures 36 are inserted into or molded into a supporting structure 50 with a grip or handle 51 that contains a guide surface 53 that rests against the face 52 of the ski 57 in order to position the sharpener along an edge of the ski so that the abrasive surfaces of the interdigitating structure 36 are established at the appropriate angle relative to the bottom face 52 of the ski 57 and relative to the faces of a metal corner strip 54 of the ski 57 that serves as a rigid durable edging for the ski structure. The angle α between the interdigitating structures is commonly less than 90° and its angular bisector is commonly asymmetrical about the corner. An extension 58 of handle 51 terminating at face 53 rests against face 52 of the ski 57 creating an angular spacing between the bottom face 52 of the ski and the handle 51. The spacing is reflected by the angle b. The size of angle b would determine the angle at which the horizontal leg of strip 54 would be sharpened relative to the plane of base 52 of the ski 57. The angle α can be set to determine the angle that the vertical leg of strip 54 would be sharpened. For example, each angle might be 1°–2° or more off true horizontal and true vertical. Both legs of strip 54 would be simultaneously sharpened.

Figure 15:
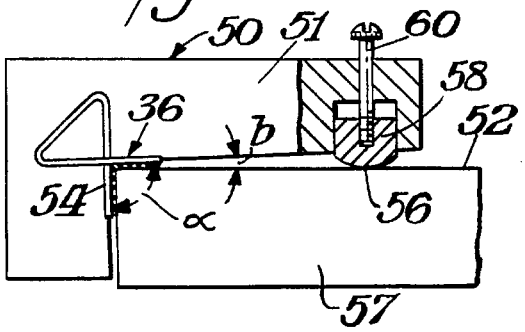
FIG. 15 is a view similar to FIG. 14 of a modified form of ski sharpener.

The angle b as illustrated in FIG. 14 is fixed. The angle guide can be made adjustable as shown in FIG. 15 in order to vary the angle b between the supporting structure 50 and the coated comb structure 36 which is attached securely to the supporting structure 50. As shown therein the guide surface 56 is the arcuate surface of guide block 58 mounted to handle 51 by fastener 60. Fastener 60 which could be a screw or bolt is manipulated to control the distance guide surface 56 extends below handle 51 and thereby control the angle b. The guide surface 56 should be of a material such as polypropylene that will not damage the face of the ski surface. Alternatively it can be a ball, a portion of a ball, or a roller as with respect to FIGS. 11–13 or in the parent U.S. Pat. No. 5,390,431.

In use for skis, the sharpener is placed in contact with the face 52 of the ski 57 as shown in FIGS. 14–15 and moved longitudinally along the metal corner strip 54 of the ski. It can then be moved to the second metal corner strip (not shown) that runs along the other corresponding edge of the ski that also contacts the snow and ice. The angle α can be varied if desired by a means such as shown in FIG. 6. By independently changing angles α and b, the interdigitating comb structures 36 can be made to conform to any desired angles on the faces of the metal insert in the ski.

Configurations of sharpeners similar to those described herein can also be conveniently used for sharpening the corner "edges" of ice skates and the like. For ice skates, one grit size might be used on one set of teeth and a different grit can be used on the second set in order to put one type of finish on the side of the blade and another on the bottom. For both skates and skis there is an advantage in being able to adjust the sharpening angle depending on the use and the particular ice or snow conditions. There are many known means to adjust the sharpening angle between the interdigitating teeth known to those skilled in mechanical arts and the invention is not intended to be limited to the means shown in FIG. 6.

The sharpener of this invention can be used by moving either the sharpener or the object while the other is stationary or by moving both simultaneously as long as relative movement of the object through the sharpening structure 36 is effected.

It is to be understood that various features shown in different embodiments may be incorporated in other embodiment herein within the spirit of this invention.

What is claimed is:

1. A method of sharpening the edge of an elongated object comprising providing a sharpening element formed from a single abrasive sharpening element having an abrasive coated planar comb-like structures formed along opposing sides of the sharpening element with the comb-like structures consisting of alternating teeth and slots and with the sharpening element being bent into an X-shape wherein the comb-like structures interdigitate to form the x-shape configuration and form a sharpening angle between the interdigitating teeth and whereby a bisection line is located at the angle with an elongated interrupting sharpening surface formed by teeth from one of the abrasive coated structures being juxtaposed at least one tooth from the other of the structures to form the elongated interrupted sharpening surface with the plurality of abrasive surfaces and the plurality of open areas, and subjecting the edge being sharpened to repeated alternating contact with the surface of each comb-like structure as the object moves relatively through the sharpening section.

2. The method of claim 1 including locating at least one guide member near the interdigitating structure to guide the object as the edge is moved across the abrasive coated structures.

3. The method of claim 3 wherein the elongated object is a knife having a blade face, and locating the guide member so that when the blade face contacts the guide member the center line of the blade established from its edge to the center of its thickness at its back is positioned generally at the bisection line of the included angle of the abrasive coated interdigitating surfaces.

4. The method of claim 2 wherein the elongated object is a ski which is moved through the sharpening section.

5. The method of claim 4 including providing means to alter the position of the guide surface in a manner that varies the angular relationship between the bottom face of the ski and the abrasive coated comb-like structure in contact with the corner of that face.

6. The method of claim 4 wherein the relative movement results from moving the sharpening section.

7. The method of claim 1 wherein a second sharpening section is provided having a second set of comb-like structures interdigitated at a second sharpening angle larger than the sharpening angle of the first sharpening section, and rigidly mounting guide members near the interdigitating structures in each of the sharpening sections, guiding the blade as the edge is moved across the abrasive coated interdigitating structures in each of the sharpening sections by positioning the blade wherein the guide members contact the same face of the blade in each of the sharpening sections and position the center line of the blade established from its edge to the center of its thickness at its back generally at the bisection line of the sharpening angle of each of the sharpening sections.

8. The method of claim 1 wherein the relative movement results from moving the object.

9. The method of claim 1 wherein the relative movement results from moving the sharpening section.

10. An apparatus for sharpening the edge of an elongated object comprising a housing having an exposed sharpening section, a sharpening element in said sharpening section, said sharpening element being formed from a single abrasive coated sharpening element having a pair of abrasive coated planer rigidly stationarily mounted comb-like structures formed along opposing sides of said sharpening element, said comb-like structures consisting of alternating teeth and slots, said sharpening element being bent into an X shape configuration with a base wherein the comb-like structures interdigitate to form the X shape configuration and form a sharpening angle between said interdigitating teeth, said angle having a bisection line, elongated interrupted sharpening surfaces being at the vertex of said x-shape, and each of said teeth from one of said abrasive coated comb-like structures being juxtaposed at least one tooth from the other of said structures to form said elongated interrupted sharpening surfaces with a plurality of abrasive surfaces and a plurality of open areas whereby the edge being sharpened is subjected to repeated alternating contact with the surface of each comb-like structure as the object is moved through said sharpening section.

11. An apparatus according to claim 10 including at least one guide member located near said interdigitating structure to guide the object as the edge is moved across said abrasive coated structures.

12. An apparatus according to claim 11 for use for sharpening a knife having a blade face, said guide member being located so that when the blade face contacts said guide member the center line of the blade established from its edge to the center of its thickness at its back is positioned at or near the bisection line of said included angle of said abrasive coated interdigitating surfaces.

13. An apparatus according to claim 11 where the elongated object is a ski and including means to alter the sharpening angle.

14. An apparatus according to claim 11 where the elongated object is a ski, and including means to alter the position of the guide surface in a manner that varies the angular relationship between the bottom face of the ski and said abrasive coated comb-like structures in contact with the corner of that face.

15. An apparatus according to claim 10 including a first sharpening element in a first sharpening section where a first set of the comb-like structures interdigitate to form a first sharpening angle, and a second sharpening element in a second sharpening section where a second set of the comb-like structures interdigitate to form a second sharpening angle larger than the first sharpening angle.

16. An apparatus according to claim 15 for sharpening a blade, including individual rigidly mounted guide members located near said interdigitating structures to guide the blade as the edge is moved across said abrasive coated interdigitating structures in each the first and second sharpening sections, said guide members being positioned to contact the same face of the blade in each of the sharpening sections and to position the center line of the blade established from its edge to the center of its thickness at its back generally at the bisection line of the sharpening angle in each of said first and second sharpening sections.

17. An apparatus according to claim 16 where said guide members are elongated rollers.

18. An apparatus according to claim 16 where said guide members are spherical balls.

* * * * *